United States Patent [19]

Babler et al.

[11] Patent Number: 5,066,150

[45] Date of Patent: Nov. 19, 1991

[54] LOW COST QUIET IMPACT PRINTER

[75] Inventors: Egon S. Babler, Northbrook; Johannes F. Gottwald, Park Ridge; Dennis W. Gruber, Arlington Heights; James F. Kearney; William J. Mayer, both of South Barrington; Alf J. Olsen, Elk Grove Village, all of Ill.

[73] Assignee: Xerox Corporation, Stamford, Conn.

[21] Appl. No.: 510,654

[22] Filed: Apr. 18, 1990

[51] Int. Cl.[5] ..... B41J 9/26

[52] U.S. Cl. ..... 400/157.3; 400/144.2; 400/166; 101/93.48

[58] Field of Search ..... 400/157.2, 157.3, 144.2, 400/166, 167; 101/93.17, 93.33, 93.48

[56] References Cited

U.S. PATENT DOCUMENTS

| | | | |
|---|---|---|---|
| 1,261,751 | 4/1918 | Anderson . | |
| 2,114,659 | 4/1938 | Salzberger | 197/17 |
| 2,875,879 | 3/1959 | Auerbach | 197/14 |
| 4,147,438 | 4/1979 | Sandrone et al. . | |
| 4,192,230 | 3/1980 | Blom et al. | 400/157.3 |
| 4,347,786 | 9/1982 | Sweat, Jr. et al. | 400/157.3 |
| 4,668,112 | 5/1987 | Gabor et al. . | |
| 4,681,469 | 7/1987 | Gabor | 400/157.2 |
| 4,832,517 | 5/1989 | Minaminaka | 400/144.2 |
| 4,867,584 | 9/1989 | Savage et al. | 400/157.3 |
| 4,893,950 | 1/1990 | Ragen et al. | 400/144.2 |
| 4,902,147 | 2/1990 | Imai et al. | 400/144.2 |

FOREIGN PATENT DOCUMENTS 7065 1/1984 Japan .

*Primary Examiner*—Edgar S. Burr
*Assistant Examiner*—Joseph R. Keating
*Attorney, Agent, or Firm*—Serge Abend

[57] ABSTRACT

A serial impact printer including a platen mounted for rotation upon a support frame, a print element having character imprinting portions disposed thereon and a print element selector for moving the print element to position a selected character imprinting portion at a printing position. A high effective mass hammer, driven toward and away from the platen in a timed manner, drives each selected character imprinting portion for deforming the platen with a printing force. A carriage mounted for reciprocating movement generally parallel to the platen, supports thereon the print element, the print element selector, the hammer and the hammer driver, and a stationary reaction bar secured to the support frame is spaced from and extends parallel to the platen. The reaction bar incudes a reaction surface against which the carriage is urged for developing the printing force as the hammer deforms the platen.

9 Claims, 5 Drawing Sheets

LOW COST QUIET IMPACT PRINTER

FIELD OF THE INVENTION

This invention relates to an impact printer engine for use in low cost typewriters in which impact noise generation, during the printing operation, is substantially reduced.

BACKGROUND OF THE INVENTION

The office has, for many years, been a stressful environment due, in part, to the large number of objectionable noise generators, such as typewriters, high speed impact printers, paper shredders, and other office machinery. Where several such devices are placed together in a single room, the cumulative noise pollution may even be hazardous to the health and well being of its occupants. The situation is well recognized and has been addressed by governmental bodies who have set standards for maximum acceptable noise levels in office environments. Attempts have been made by office machinery designers, in the field of impact printers, to reduce the noise pollution. Some of these methods include enclosing impact printers in sound attenuating covers, designing impact printers in which the impact noise is reduced, and designing quieter printers based on non-impact technologies such as ink jet and thermal transfer.

The low cost personal typewriter is purchased primarily for home usage (including both personal and in-home office) and for school usage. It is particularly desirable in these environments to reduce the acoustic noise level of the printing mechanism at the source to levels which are unobtrusive. For example, in the home, other members of the family should not be distracted by the clatter of typing if conducted in common rooms. In a secondary school or college setting, colleagues and others should not be disturbed if the user types in a library, a study hall or a dormitory room. Heretofore such usage has not been possible because typewriters are notoriously noisy devices. The silent operation of our low cost quiet typewriter will enable such usage because silence transports such useful appliances into new physical settings and enhances portability. A derived benefit will be freer communication among work group members as the user is able to work directly in the group in a non-irritating manner.

The industrial typewriter market segment is at the high end of the product cost continuum, i.e. in the $1000 to $2000 range. Thus, the incremental increase in manufacturing costs necessitated by numerous design changes represents a relatively small percentage of the product cost which is passed on to the ultimate purchaser. At the opposite end of the product cost continuum, i.e. in the $150 to $300 range, there is the consumer, or commodity, market. Clearly, any modification necessitated by the implementation of a sound reduction design will of necessity be extremely low in cost because the incremental increase in product cost to the consumer will not warrant a large percentage rise in this market.

An explanation of noise measurement is appropriate to explain the following statements regarding noise abatement achieved by our invention. Noise measurements are often referenced as dBA values. The "A" scale, by which the sound values have been identified, represents humanly perceived levels of loudness as opposed to absolute values of sound intensity. When considering sound energy represented in dB (or dBA) units, it should be noted that the scale is logarithmic and that a 10 dB difference equals a factor 10, a 20 dB difference equals a factor of 100, a 30 dB equals a factor of 1000, and so on.

Typical typewriters generate impact noise in the range of 65 to just over 80 dBA. These sound levels are deemed to be intrusive. For example, the IBM Selectric ball unit generates about 78 dBA, while the Xerox Memorywriter generates about 68 dBA, and the low cost Smith Corona Correcting Portable generates about 70 dBA. When reduced to the high 50s dBA, the noise is construed to be objectionable or annoying. It would be highly desirable to reduce the impact noise to a value in the vicinity of 50 dBA. The low cost typewriter of the present invention has been typically measured at about 50 dBA. This represents a dramatic improvement on the order of about 100 times less sound pressure than present day low cost typewriters, a notable achievement toward a less stressful environment.

The major source of noise in the modern typewriter is produced as the hammer impacts and drives a character pad to form an impression on a receptor sheet. Character pads are carried upon and transported past a print station at the ends of the rotating spokes of a printwheel. When a selected character is to be printed, it is stopped at the print station and the hammer drives it against a ribbon, the receptor sheet and a supporting platen, with sufficient force to release ink from the ribbon onto the receptor sheet.

In conventional ballistic hammer impacting typewriters a hammer mass of about 2.5 grams is ballistically propelled by a solenoid actuated clapper toward the character/ribbon/paper/platen combination. After the hammer hits the rear surface of the character pad, its momentum continues to drive it toward and against the ribbon/paper/platen combination and to deform the platen surface. Once the platen has absorbed the hammer impact energy it seeks to restore its normal shape by driving the hammer back to its home position where it must be stopped, usually by another impact. This series of high speed impacts is the main source of the objectionable impact noise in these printers.

Typically the platen deformation impact is very short, on the order of 100 microseconds duration. Intuitively it is known that a sharp, rapid impact will be noisy and that a slow impact will be less noisy. Thus, if the impact duration were slowed it would be possible to make the device quieter. In low end typewriters with printing speeds in the 10 to 12 character per second range, the mean time available between character impacts is about 85 to 90 milliseconds. More of that available time can be used for the hammer impact than the usual 100 microseconds. If, for example, the platen deformation time were stretched to even 5 to 10 milliseconds this would represent a fifty to one hundred-fold increase, or stretch, in the impact pulse width. It is also intuitive that in order for a slow impact to deform the platen by the same amount, for releasing the ink from the ribbon, a larger hammer mass (or effective mass) must be used. This is because manipulation of the time domain of the deformation changes the frequency domain of the sound waves emanating therefrom, so that as the impulse deformation time is stretched, the sound frequency (actually a spectrum of sound frequencies) emanating from the deformation is proportionately reduced and the perceived noise output of the lower frequencies is reduced. Since this is a resonant system, the mass will be inversely proportional to the square of the frequency shift. Therefore, a one hundred-fold increase in the time domain (100 microseconds to 10 milliseconds) will proportionately reduce the frequency output when a ten thousand-fold increase in the mass is effected. Clearly it would not be practical to increase the actual mass of the hammer by such a factor. As an alternative to increasing the hammer mass per se, its effective mass may be increased by means of a mechanical transformer.

PRIOR ART AND RELATED PATENTS

The general concept implemented in the present typewriter, i.e. reduction of impulse noise achieved by stretching the deformation pulse and impacting with an increased hammer mass, has been recognized for many decades. As long ago as 1918, in U.S. Pat. No. 1,261,751 (Anderson) quieter operation of the printing function in a typewriter was proposed by increasing the "time actually used in making the impression". A type bar typewriter operating upon the principles described in this patent was commercially available at that time.

The quiet impact printing mechanism incorporating the theory of operation of the present invention is explained in the following two commonly assigned patents either one of whose disclosures is herein fully incorporated by reference. U.S. Pat. No. 4,681,469 (Gabor), entitled "Quiet Impact Printer", relates to greatly increasing the effective mass of the hammer, introducing the hammer to the platen at a relatively slow speed and causing the platen deformation to take place over an extended period of time. In U.S. Pat. No. 4,668,112 (Gabor et al) entitled "Quiet Impact Printer" it is taught to control the movement of the hammer from its home position to its application of impact force, whereby the hammer mass is moved toward the platen and will continue to move until an encounter with the platen is effected. As the hammer nears the surface of the platen its velocity is significantly diminished so that impact takes place at a very slow speed. Subsequent to initiation of contact, the hammer force is increased to deform the platen.

In both the '469 and '112 patents a mass transformer, comprising a heavy rockable bail bar driven by a voice coil motor, urges a push rod toward and away from the platen in a controlled manner. The push rod in turn moves a print tip (hammer) into deforming contact with the platen. A sensor mounted upon the print tip indicates the moment of contact with the platen so that an additional application of kinetic energy may be provided by the voice coil motor at that juncture. By means of this arrangement a suitable controller, connected to the voice coil motor, moves the print tip across a throat distance between its home position and the surface of the platen in a controlled ballistic manner, i.e. the print tip is set in motion and will arrive at the platen surface regardless of its location ("self levelling"), and then controls the duration of the platen deformation with this high effective mass.

U.S. Pat. No. 2,114,659 (Salzberger) discloses a type lever typewriter for "practically noiselessly" pressing the character pad against the platen. Shortly prior to the character pad contacting the platen on its flight from a rest position, a force applying roller follows the pad and presses it against the platen with gradually increasing force. Clearly, if the roller is to be effective it must be accurately located relative to the platen within tight tolerances and it must be rotated at precisely the correct time in the printing cycle. Any deviation in position or timing will subvert the printing cycle. In U.S. Pat. No. 2,875,879 (Auerbach) there is disclosed a "noiseless" typewriter wherein the type character is pressed against the platen by an electromagnetic driver. As the type lever engages the platen, "or very nearly so", it trips a switch to energize the electromagnet for urging the type character against the platen. It is important that the electromagnet driver is accurately positioned relative to the type lever in order to effect the proper platen impact.

In Japanese Patent Application No. 59-7065 (Kaidou) there is disclosed a dot matrix printer wherein a platen impact force is determined and corrections are made to a subsequent drive force application in order to achieve optimum operating conditions. This arrangement is provided to compensate for the number or type of receptor sheet being used in the printer. A piezoelectric element installed in the platen senses the impact force and generates a voltage which is compared with an optimal striking force voltage. If the receptor is changed the difference in force is sensed and the striking force is corrected by varying the ballistic pin driver. It should be noted that once the ballistic pin (hammer) is set in motion with a selected drive force, no further corrections can be made.

It is the primary object of the present invention to provide a very low cost quiet impact printer wherein a large effective mass, acting over an extended contact period, is "kinetically" driven to an unknown contact point while being subject to active control throughout its trajectory. Upon encountering its contact point a Print Force is developed.

SUMMARY OF THE INVENTION

The present invention may be carried out, in one form, by providing a serial impact printer including a platen mounted for rotation upon a support frame, a print element having character imprinting portions disposed thereon and a print element selector for moving the print element to position a selected character imprinting portion at a printing position. A high effective mass hammer, driven toward and away from the platen in a timed manner, drives each selected character imprinting portion for deforming the platen with a printing force. The hammer motion characteristics and the level of force application are determined by a D.C. motor acting through a displacement and force modifying mechanism.

A microprocessor controlled feedback system determines the proper speed of the hammer throughout its travel and the appropriate force levels to be applied thereby to the platen. The print element, print element selector, hammer, hammer displacement mechanism, marking and lift-off ribbons and controls for these elements are all supported upon a carriage laterally movable along and rotationally movable about a support rail. The reaction bar extending across the printer is accurately positioned to be parallel to the platen and provides a reaction surface for developing the printing force as the hammer is driven against the platen and for accurately positioning the transversely moving elements.

BRIEF DESCRIPTION OF THE DRAWINGS

Other objects and further features and advantages of this invention will be apparent from the following, more particular, description considered together with the accompanying drawings, wherein.

DETAILED DESCRIPTION OF THE ILLUSTRATED EMBODIMENT

Figure 1:
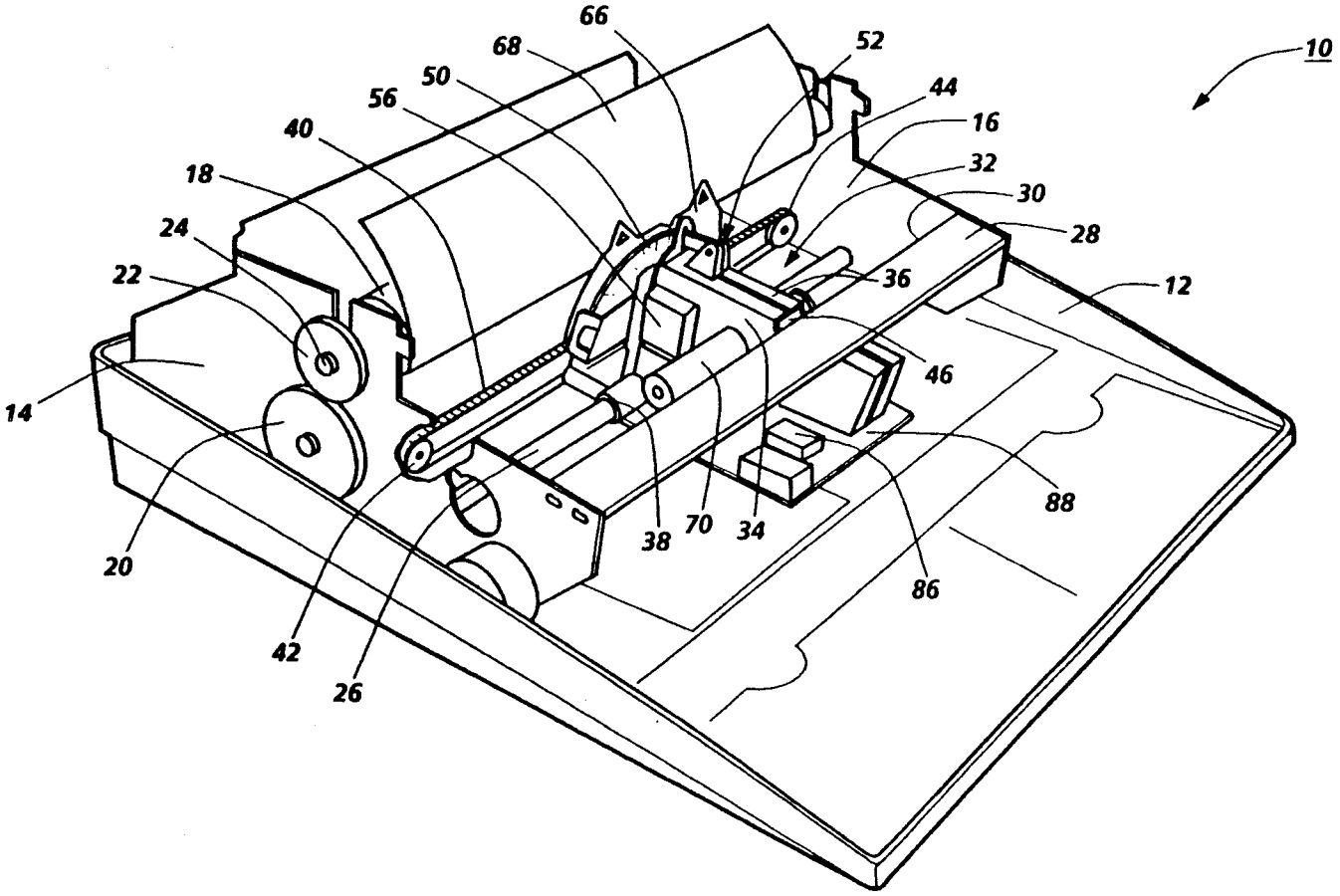
FIG. 1 is a perspective view schematically showing the carriage, the reaction bar and other relevant features of a low cost quiet impact typewriter.
Figure 2:
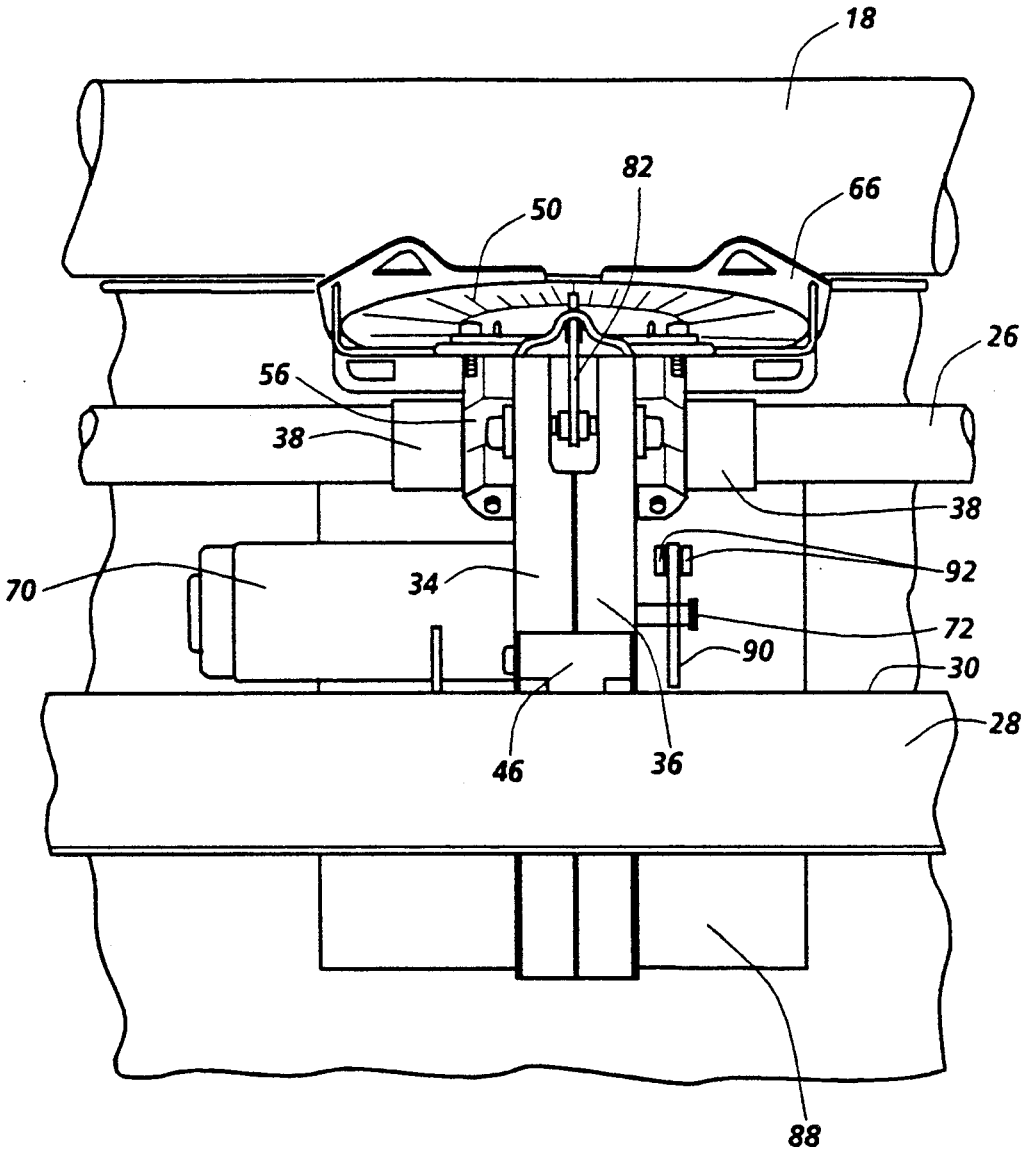
FIG. 2 is a schematic partial plan view looking down upon the carriage.

The salient features of the novel, low cost quiet impact printer 10 of the present invention will now be described with reference to the drawings. An enclosure (only the base 12 is shown) houses its relatively few moving parts. Vertically upstanding left and right side plates 14 and 16 are each secured to the base and support platen 18 therebetween, for rotation in seats therein. The platen is driven by a suitable motor (not shown) through a gear train including driving gear 20 and driven gear 22 on the platen shaft 24. The side plates also support the ends of a highly polished guide rod 26 and the ends of reaction bar 28 having an accurately machined guiding edge 30. The reaction bar is mounted so as to be adjusted to control the distance of the guiding edge from and to maintain it parallel to the platen surface.

A printer carriage 32 comprised of carriage frame plates 34 and 36 each having a bearing 38 mounted thereon is supported upon the guide rod 26 for reciprocating movement therealong, across the length of the platen. Carriage reciprocation is controlled by a motor (not shown) which drives a toothed spacing belt 40, secured to the carriage, over pulleys 42 and 44. As the carriage 32 moves along the guide rod 26 on bearings 38 it will tend to rotate in a clockwise direction thereabout (as viewed in FIG. 1) under the influence of gravity, and biases bearing shoe 46 against the guiding edge of reaction bar 28. The shoe is made of a hard, low friction material, such as Delrin®, an acetal resin thermoplastic. This carriage mounting arrangement facilitates inexpensive assembly of the printing device because it eliminates criticality in the placement of the guide rod, requiring only one element, the reaction bar 28, to be accurately positioned. By adjusting the ends of the reaction bar relative to the side plates 14 and 16, the guiding edge 30 may be accurately positioned parallel to the platen, so that as the carriage 32 traverses the printer all the printing elements carried thereon will be in their proper position relative to the platen.

Figure 3:
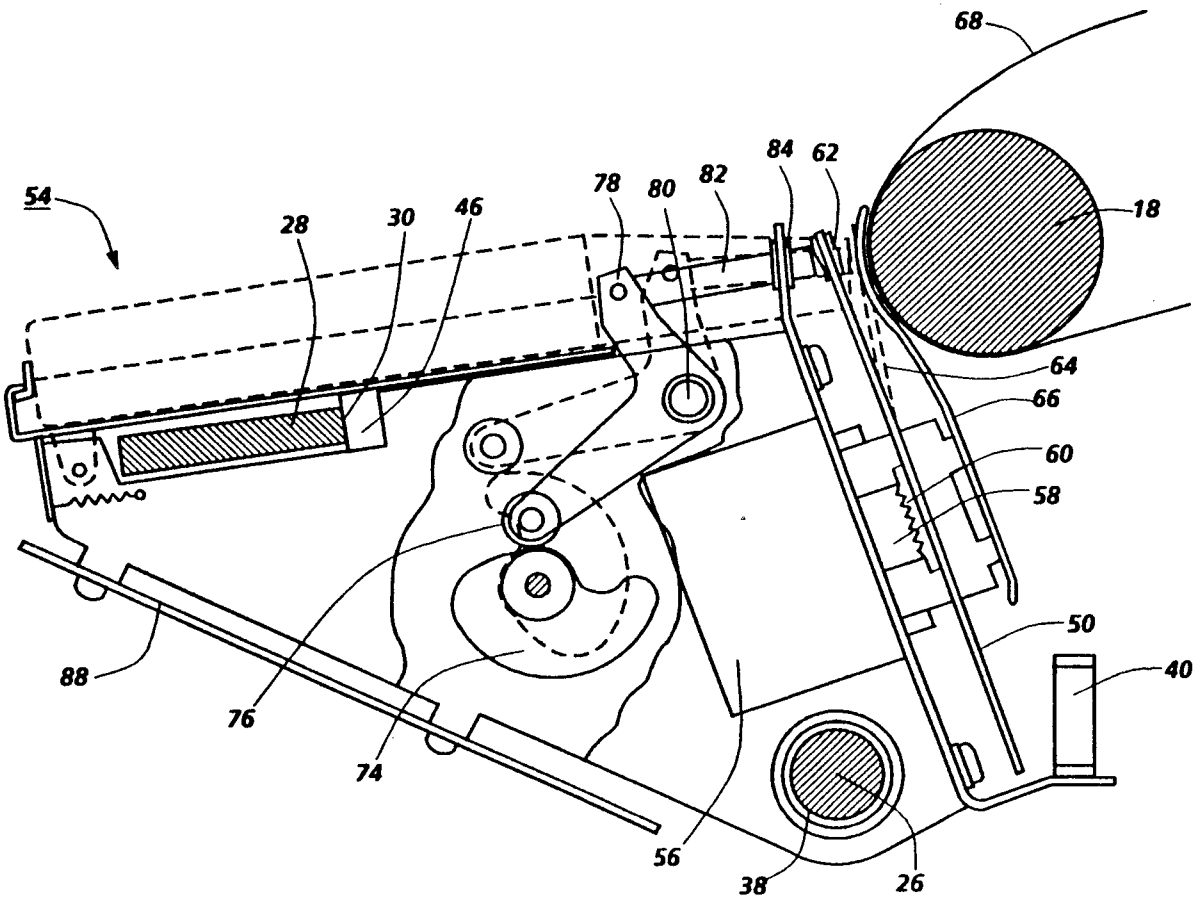
FIG. 3 is a schematic sectional view showing the hammer driver.

The printing elements comprise a printwheel 50, a hammer assembly 52 and a ribbon pack assembly 54 (seen in FIG. 3). A printwheel drive motor 56 mounted on the carriage frame plates 34 and 36 has a drive coupling 58 to which a printwheel hub 60 may be connected for rotation of the character pads 62 (located at the ends of printwheel spokes 64) past a print station adjacent to the platen. Selective rotation of the drive motor 56 under processor control, initiated by keystrokes, locates and arrests the desired character pad 62 at the print station. A resilient card guide 66 also mounted on the carriage frame plates holds an image receptor sheet 68 in intimate contact with the platen surface.

The hammer assembly 52 is best seen in FIG. 3 wherein carriage frame plate 34 has been cut away to better reveal it. A hammer actuating D.C. motor 70 is mounted upon carriage frame plate 36 with its drive shaft 72 extending through and beyond both frame plates. Drive cam 74 secured to the shaft moves cam follower 76 to rotate bell crank 78, upon which it is carried, about pivot pin 80. The hammer 82 is pinned at the opposite end of the bell crank and slides through a stationary guide bearing 84. As the cam rotation is effected in a predetermined controlled manner by the D.C. motor, in response to signals received from the controller 86, mounted upon circuit board 88 secured to the carriage, the hammer is moved toward and away from the platen. In addition to rotating the cam 74, the motor 70 rotates a timing disc 90 which may be in the form of a simple optical encoder, in combination with sensor 92, capable of generating displacement and direction outputs for sending positioning information back to the controller. The controller uses this information to keep track of the instantaneous hammer position, as well as to derive system velocity.

Small D.C. motors of the type employed in this invention are in widespread use in small appliances. Consequently they are inexpensive and readily available from many sources. Most importantly, however, D.C. motors have characteristics particularly desirable for the application of the hammer force required in the present invention. Namely, they achieve high speeds under light load and produce large torques at low speeds. In the present application, the motor can initially rapidly move the hammer to close the throat between the hammer "home" position and the initiation of platen deformation and subsequently apply the necessary torque to control the deformation force after contact has been made. Furthermore, contact may be determined easily by sensing a sudden decrease in velocity of the motor. Motor motion can be controlled with a simple feedback system under processor control, based upon the position, speed and direction of rotation of timing disc 90.

Figure 4:
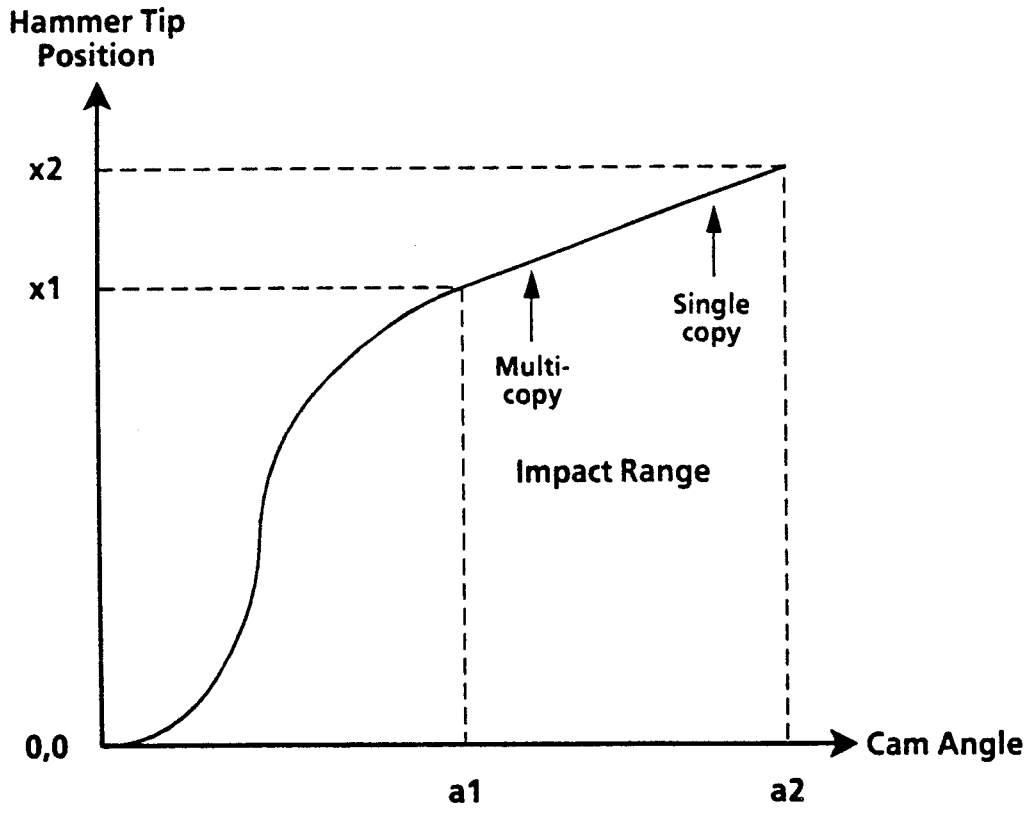
FIG. 4 is a graphical representation of the hammer cam transfer characteristics.

As taught in the '469 and '112 patents, in order to achieve low impact noise the hammer must initiate contact at a very slow velocity but in order to achieve a satisfactory printing speed it must move rapidly across the throat. These movement characteristics are determined by the cam profile and the D.C. motor rotational speed as determined by the controller 86. A representation of the cam displacement characteristics can be seen in FIG. 4. A first cam region will result in the illustrated sinusoidal hammer displacement. Harmonic motion has been selected in order to move the hammer smoothly so as to minimize acoustic noise and component wear. A second cam region will result in the shallow straight line displacement (e.g. 0.001 inch/degree of motor rotation). The straight line cam region should overlap the range in which impact is expected, i.e. from the surface of a multi-sheet pile ($x_1$) to the surface of a single sheet ($x_2$). To this end, the guiding edge 30 of reaction bar 28 must be adjusted toward or away from the platen surface so that the $x_1$–$x_2$ displacement range of the drive cam 74 corresponds with those receptor sheet conditions. The linearity of this second cam region results in a linear relationship between the motor current and the hammer force so that its slope may be selected to yield the maximum force needed for a particular system in view of the torque available from the motor. The print force is resolved as the hammer 82 is driven against the platen and the shoe 46 is driven against the reaction bar 28. The presence of the reaction bar transforms the hammer into a high effective mass at the moment of impact, enabling the high print force to be obtained at the slow hammer speed. Ideally, if the hammer and the reaction bar were aligned the print force and the reaction force would be equal and opposite and no other system elements would experience any force at impact. However, in view of design constraints it is often not possible to align these forces, in which case there will be a force through the carriage and other elements of the system, including the guide rod 26, all of which should be minimized.

Figure 5:
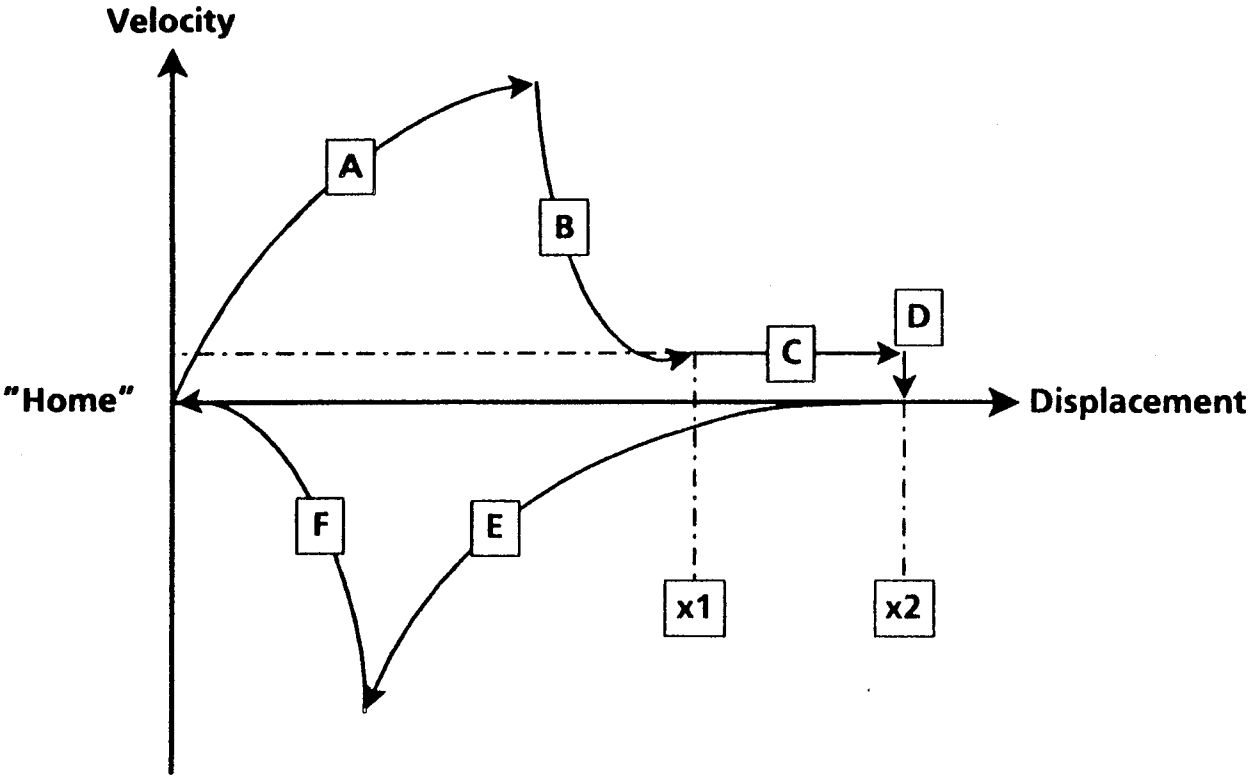
FIG. 5 is a state diagram showing a typical print cycle for this device.

Turning to FIG. 5 there is illustrated a state diagram showing a typical print cycle for this device as established by the controller 68 which sets driving parameters for the cycle based upon information from the previous cycle and outputs control signals to the motor driver circuits. Hammer velocity is plotted against its displacement from its "home" position.

In Acceleration State A the hammer is accelerated forward for approximately half the distance to the expected impact point by applying a controlled current to the D.C. motor.

In Deceleration State B the hammer is decelerated toward point $x_1$ (the beginning of the straight portion of the transfer characteristic) by applying a reverse voltage to the D.C. motor until the velocity reaches a predetermined slow approach velocity of about one to two inches per second.

In Approach State C the hammer approaches the platen under the controlled slow velocity until impact occurs which is signified by and sensed as a sudden change in velocity.

During Deformation State D a constant current is applied to the motor to generate a fixed deformation force, wherein the magnitude of the impression current depends upon the force required to print the selected character.

After printing of the character, Return State E is effected during which the D.C. motor is accelerated in reverse for approximately one-half the distance to the "home" position.

Finally, in Deceleration State F the hammer is decelerated by applying a reverse potential until it is near its "home" position, followed by a dynamic braking to settle the hammer at its "home" position.

As each character is printed in the above-described manner the cam location of the hammer impact position at the end of Approach State C is updated in memory. During the next subsequent cycle this updated information is used to calculate a new deceleration initiation point. Controlled in this manner, the system provides an automatic "rolling" compensation along the axial length of the platen for overcoming mechanical variations in the distance from the hammer "home" position to the platen surface, such as platen skew, platen eccentricity, paper stock thickness, etc. An initialization cycle may be implemented prior to the initial print cycle in order to establish memory values. Alternatively, initialization default values may be used based upon the assumption that impact will occur at a minimum position. Then in each subsequent cycle the control algorithm adjusts the braking point so as to minimize the duration of the slow Approach State C.

It should be understood that the present disclosure has been made only by way of example and that numerous changes in details of construction and the combination and arrangement of parts may be resorted to without departing from the true spirit and scope of the invention as hereinafter claimed.

What is claimed:

1. A serial impact printer comprising a support frame, a platen mounted for rotation upon said support frame, a print element having character imprinting portions disposed thereon, a print element selector for moving said print element to position a selected character imprinting portion at a printing position, a hammer for moving a selected character imprinting portion for deforming said platen with a printing force, and means for moving said hammer toward and away from said platen, the improvement comprising said means for moving said hammer including a D.C. motor in combination with means for varying the rate of displacement of said hammer and a feedback system including a controller electrically connected to said D.C. motor, wherein the speed of said hammer is continually determined by said feedback system, said feedback system further including means for indicating the position, speed and direction of said motor, a carriage mounted for reciprocating movement generally parallel to said platen, said carriage supporting thereon said print element, said print element selector, said hammer and said means for moving, and a stationary reaction bar secured to said support frame and being spaced from and extending parallel to said platen, said reaction bar including a reaction surface against which said carriage is urged for developing said printing force as said hammer deforms said platen.

2. The serial impact printer as defined in claim 1 wherein said means for varying comprises a cam.

3. The serial impact printer as defined in claim 2 wherein said cam comprises a first region for rapidly displacing said hammer and a second region for slowly displacing said hammer.

4. The serial impact printer as defined in claim 3 wherein said first region results in harmonic displacement and said second region results in shallow straight line displacement.

5. The serial impact printer as defined in claim 1 wherein said means for sensing comprises a timing disc in combination with a sensor.

6. The serial impact printer as defined in claim 1 wherein said controller is mounted upon a circuit board carried by said carriage.

7. The serial impact printer as defined in claim 1 further including a guide rail upon which said carriage is mounted for reciprocating movement and about which said carriage is free to rotate toward and away from said platen so that said carriage is biased, under the influence of gravity, against said reaction bar.

8. The serial impact printer as defined in claim 7 wherein said carriage includes means for sliding freely upon said reaction surface.

9. A method of serial impact printing comprising the steps of moving a rotatable print element having character imprinting portions disposed thereon past a printing zone adjacent a platen, arresting a selected character imprinting portion at said printing zone, moving a hammer toward and away from said platen for driving said selected character imprinting portion to deform said platen with a printing force, the improvement comprising reciprocally moving a carriage generally parallel to said platen, said carriage supporting thereon said print element, said print element driver, said hammer and said hammer driver, providing a stationary reaction bar spaced from and parallel to said platen, and providing a feedback system including a controller electrically connected to a D.C. motor, continually determining the hammer velocity with said feedback system, sensing the moment of hammer impact by sensing a sudden change in the velocity of said motor using said feedback system, applying said printing force subsequent to sensing the moment of hammer impact, and urging said carriage against said reaction bar while urging said hammer to deform said platen for developing said printing force.

* * * * *